US010672307B2

(12) United States Patent
Kesler

(10) Patent No.: US 10,672,307 B2
(45) Date of Patent: Jun. 2, 2020

(54) FLAG HOLDER FOR VEHICLE

(71) Applicant: Christopher G. Kesler, Fruit Heights, UT (US)

(72) Inventor: Christopher G. Kesler, Fruit Heights, UT (US)

( * ) Notice: Subject to any disclaimer, the term of this patent is extended or adjusted under 35 U.S.C. 154(b) by 211 days.

(21) Appl. No.: 15/714,762

(22) Filed: Sep. 25, 2017

(65) Prior Publication Data

US 2018/0090038 A1 Mar. 29, 2018

Related U.S. Application Data

(60) Provisional application No. 62/398,983, filed on Sep. 23, 2016.

(51) Int. Cl.
*G09F 17/00* (2006.01)

(52) U.S. Cl.
CPC ..... *G09F 17/00* (2013.01); *G09F 2017/0075* (2013.01)

(58) Field of Classification Search
CPC ..... G09F 17/00; G09F 2017/0075
See application file for complete search history.

(56) References Cited

U.S. PATENT DOCUMENTS 1,856,519 A * 5/1932 Spears ..... G09F 13/04 40/564
2,055,397 A * 9/1936 Zaiger ..... F16B 47/00 116/DIG. 24
2,260,787 A * 10/1941 Nichols ..... B60R 13/00 248/513
3,273,118 A * 9/1966 Hendershot ..... B60Q 7/00 116/173
3,623,254 A * 11/1971 Parish, Sr. ..... B60Q 7/005 40/591
3,797,450 A * 3/1974 Frisbee ..... G09F 17/00 116/28 R
4,686,785 A * 8/1987 Obbermito ..... E01F 9/669 40/583
4,900,286 A * 2/1990 Buffalo ..... A63H 27/04 446/30
5,042,418 A 8/1991 Hoover et al.
5,062,380 A * 11/1991 Chestnutt ..... G09F 21/04 116/175
5,299,525 A * 4/1994 Romesburg ..... B60R 13/005 116/173
5,320,061 A * 6/1994 Laughlin ..... B60Q 1/50 116/173
5,339,551 A * 8/1994 Elmer ..... G09F 21/04 40/591

(Continued)

*Primary Examiner* — Nimeshkumar D Patel
*Assistant Examiner* — Tania Courson
(74) *Attorney, Agent, or Firm* — Kunzler Bean & Adamson

(57) ABSTRACT

An apparatus for displaying a flag on a vehicle while the vehicle moves at a high speed includes a first suction cup assembly adapted to be releasably secured to the vehicle, a second suction cup assembly adapted to be releasably secured to the vehicle, a first attachment device secured to the first suction cup assembly, a second attachment device secured to the second suction cup assembly, and a flag pole secured, at a first location along the flag pole, to the first attachment device and secured, at a second location along the flag pole, to the second attachment device, wherein the first location is spaced apart from the second location.

20 Claims, 12 Drawing Sheets

(56) References Cited

U.S. PATENT DOCUMENTS 5,483,916 A 1/1996 Kolvites et al.
5,692,331 A * 12/1997 Tipke ..... G09F 21/04 248/205.6
6,010,107 A 1/2000 Goldfarb
6,101,702 A * 8/2000 Claycomb ..... B25B 11/007 254/95
6,637,365 B1 * 10/2003 Adamski ..... G09F 17/00 116/173
7,066,105 B2 * 6/2006 Tal ..... B60Q 1/50 116/173
7,347,018 B2 * 3/2008 Haggard, Jr. ..... G09F 15/0025 248/206.3
7,878,139 B1 2/2011 Karnes et al.
7,992,333 B1 * 8/2011 McGuinness ..... G09F 3/16 116/28 R
D668,991 S * 10/2012 Sussman ..... D11/165
9,087,462 B1 * 7/2015 Gallus ..... G09F 17/00
9,376,054 B2 * 6/2016 Svelander ..... B60Q 1/06
9,601,039 B2 * 3/2017 Baker ..... G09F 17/00
9,623,795 B2 * 4/2017 Bowe ..... B60Q 1/2615
10,147,342 B2 * 12/2018 Gogatz ..... G09F 17/00
2004/0172872 A1 * 9/2004 Witkowski ..... G09F 17/00 40/593
2005/0051689 A1 * 3/2005 Gory ..... A47G 7/044 248/311.2
2005/0066558 A1 3/2005 Haggard, Jr.
2005/0076823 A1 * 4/2005 Sanders ..... G09F 17/00 116/173
2007/0283875 A1 * 12/2007 Durkin ..... G09F 17/00 116/173
2007/0283877 A1 * 12/2007 Durkin ..... G09F 17/00 116/209
2012/0075872 A1 * 3/2012 Byrne ..... G01S 5/16 362/362
2017/0270839 A1 * 9/2017 Buckley ..... G09F 17/00

* cited by examiner

FLAG HOLDER FOR VEHICLE

CROSS-REFERENCE TO RELATED APPLICATION

This application claims the benefit of U.S. Provisional Patent Application No. 62/398,983, filed Sep. 23, 2016, which is incorporated herein by reference.

FIELD

This disclosure relates generally to holders for securing a flag relative to an object, and more particularly to flag holders for use on automobiles, or other vehicles.

BACKGROUND

Flag holders are configured to secure a flag relative to an object. Generally, the flag holder is attached to the object and one or more flags are coupled to the flag holder. When the object is a movable object, such as a vehicle, maintaining the attachment between the flag holder and the movable object, when moving, can be difficult due to the pull-off forces, acting on the flag holder, primarily caused by the drag of the flag.

A wide variety of flag holders for vehicles exist, mostly for displaying flags or banners at low or negligible speeds. Some of these holders simply involve engaging a shaft to a vehicle window for a small flag, such as is disclosed by U.S. Pat. No. 6,010,107. Other flag holders employ some type of strap or suction cup design for small flags, such as those disclosed by U.S. Pat. Nos. 5,042,418, 5,483,916, and 7,878,139.

Small flags, which may be able to remain mounted to an automobile at highway speeds, are not likely to be seen or read by others who are also travelling at highway speeds. A large banner holder system has been devised for displaying a banner on the top of a vehicle, as shown in U.S. Patent Application Publication No. 2005/0066558 A1, but is not practical because it is large and unwieldly. It is also likely to generate major wind resistance at high speeds, which it would not be able to withstand. Consequently, there is a need to develop a device for enabling a vehicle to visibly and safely display large flags at high speeds.

SUMMARY

The subject matter of the present application has been developed in response to the present state of the art, and in particular, in response to the shortcomings of vehicle mounted flag holders, that have not yet been fully solved by currently available techniques. Accordingly, the subject matter of the present application has been developed to provide an apparatus that overcomes at least some of the above-discussed shortcomings of prior art techniques.

Disclosed herein is an apparatus for displaying a flag on a vehicle while the vehicle moves at a high speed. The apparatus includes a first suction cup assembly adapted to be releasably secured to the vehicle, a second suction cup assembly adapted to be releasably secured to the vehicle, a first attachment device secured to the first suction cup assembly, a second attachment device secured to the second suction cup assembly, and a flag pole secured, at a first location along the flag pole, to the first attachment device and secured, at a second location along the flag pole, to the second attachment device, wherein the first location is spaced apart from the second location. The preceding subject matter of this paragraph characterizes example 1 of the present disclosure.

The suction cup assemblies are adapted to fixedly secure to a curvilinear surface of the vehicle. The preceding subject matter of this paragraph characterizes example 2 of the present disclosure, wherein example 2 also includes the subject matter according to example 1, above.

The first suction cup assembly is pivotable relative to the flag pole. The second suction cup assembly is pivotable relative to the flag pole. The preceding subject matter of this paragraph characterizes example 3 of the present disclosure, wherein example 3 also includes the subject matter according to any one of examples 1-2, above.

The first suction cup assembly and the second suction cup assembly are spaced apart from each other in a first direction and the flag pole is parallel to the first direction. The preceding subject matter of this paragraph characterizes example 4 of the present disclosure, wherein example 4 also includes the subject matter according to any one of examples 1-3, above.

The first direction is a vertical direction. The preceding subject matter of this paragraph characterizes example 5 of the present disclosure, wherein example 5 also includes the subject matter according to example 4, above.

The first attachment device is slidably adjustable along the flag pole to adjust a distance between the first suction cup assembly and the second suction cup assembly and/or the second attachment device is slidably adjustable along the flag pole to adjust a distance between the first suction cup assembly and the second suction cup assembly. The preceding subject matter of this paragraph characterizes example 6 of the present disclosure, wherein example 6 also includes the subject matter according to any one of examples 1-5, above.

The first and second suction cup assembly each comprises an integrated vacuum pump. The preceding subject matter of this paragraph characterizes example 7 of the present disclosure, wherein example 7 also includes the subject matter according to any one of examples 1-6, above.

The flag pole is made of fiberglass. The preceding subject matter of this paragraph characterizes example 8 of the present disclosure, wherein example 8 also includes the subject matter according to any one of examples 1-7, above.

The apparatus further includes a first flag attachment device fixedly secured to the flag pole at a third location along the flag pole and a second flag attachment device fixedly secured to the flag pole at a fourth location along the flag pole. The preceding subject matter of this paragraph characterizes example 9 of the present disclosure, wherein example 9 also includes the subject matter according to any one of examples 1-8, above.

The first flag attachment device is further movably secured to the flag pole such that the third location is adjustable, the second flag attachment device is further movably secured to the flag pole such that the fourth location is adjustable, a distance between the third location and the fourth location is adjustable. The preceding subject matter of this paragraph characterizes example 10 of the present disclosure, wherein example 10 also includes the subject matter according to any one of examples 1-9, above.

The apparatus further includes a third flag attachment device fixedly secured to the flag pole at a fifth location along the flag pole and a fourth flag attachment device fixedly secured to the flag pole at a sixth location along the flag pole. The preceding subject matter of this paragraph characterizes example 11 of the present disclosure, wherein example 11 also includes the subject matter according to any one of examples 1-10, above.

The flag includes a size of at least three feet by five feet. The preceding subject matter of this paragraph characterizes example 12 of the present disclosure, wherein example 12 also includes the subject matter according to any one of examples 1-11, above.

The high speed is at least sixty miles per hour. The preceding subject matter of this paragraph characterizes example 13 of the present disclosure, wherein example 13 also includes the subject matter according to any one of examples 1-11, above.

The first suction cup assembly and the second suction cup assembly are attachable to a side of the vehicle. The preceding subject matter of this paragraph characterizes example 14 of the present disclosure, wherein example 14 also includes the subject matter according to any one of examples 1-13, above.

The first suction cup assembly and the second suction cup assembly are attachable to a rear side window of the vehicle. The preceding subject matter of this paragraph characterizes example 15 of the present disclosure, wherein example 15 also includes the subject matter according to any one of examples 1-14, above.

The first suction cup assembly and the second suction cup assembly are attachable to a trunk panel of the vehicle. The preceding subject matter of this paragraph characterizes example 16 of the present disclosure, wherein example 16 also includes the subject matter according to any one of examples 1-15, above.

The first suction cup assembly and the second suction cup assembly each includes a suction cup having a diameter of at least one hundred and forty millimeters. The preceding subject matter of this paragraph characterizes example 17 of the present disclosure, wherein example 17 also includes the subject matter according to any one of examples 1-16, above.

Further disclosed herein is an apparatus for displaying a flag on a vehicle while the vehicle moves at a high speed. The apparatus includes a first suction cup assembly adapted to be releasably secured to the vehicle, a second suction cup assembly adapted to be releasably secured to the vehicle, a flag pole, a means for attaching the flag pole at a first location along the flag pole to the first suction cup assembly, and a means for attaching the flag pole at a second location along the flag pole to the second suction cup assembly. The preceding subject matter of this paragraph characterizes example 18 of the present disclosure.

The apparatus further includes a means for attaching a flag to the flag pole at a third location along the flag pole, and a means for attaching the flag to the flag pole at a fourth location along the flag pole. The preceding subject matter of this paragraph characterizes example 19 of the present disclosure, wherein example 19 also includes the subject matter according to example 20, above.

Further disclosed herein is an apparatus for displaying a flag on a vehicle while the vehicle moves at a high speed. The apparatus includes a first suction cup assembly adapted to be releasably secured to the vehicle, the first suction cup assembly comprising a first integrated vacuum pump. The apparatus further includes a second suction cup assembly adapted to be releasably secured to the vehicle, the second suction cup assembly comprising a second integrated vacuum pump. The apparatus further includes a first attachment device secured to the first suction cup assembly, a second attachment device secured to the second suction cup assembly, and the flag pole, comprising fiberglass, secured, at a first location along the flag pole, to the first attachment device and secured, at a second location along the flag pole, to the second attachment device, wherein the first location is spaced apart from the second location. The first attachment device is slidably adjustable along a flag pole to adjust a distance between the first suction cup assembly and the second suction cup assembly, the first suction cup assembly is pivotable relative to the flag pole, and the second suction cup assembly is pivotable relative to the flag pole. The apparatus further includes a first flag attachment device fixedly secured to the flag pole at a third location along the flag pole, wherein the first flag attachment device is further movably secured to the flag pole such that the third location is adjustable, and a second flag attachment device fixedly secured to the flag pole at a fourth location along the flag pole, wherein the second flag attachment device is further movably secured to the flag pole such that the fourth location is adjustable. The first suction cup assembly and the second suction cup assembly are at least one hundred and forty millimeter suction cups. The preceding subject matter of this paragraph characterizes example 20 of the present disclosure.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
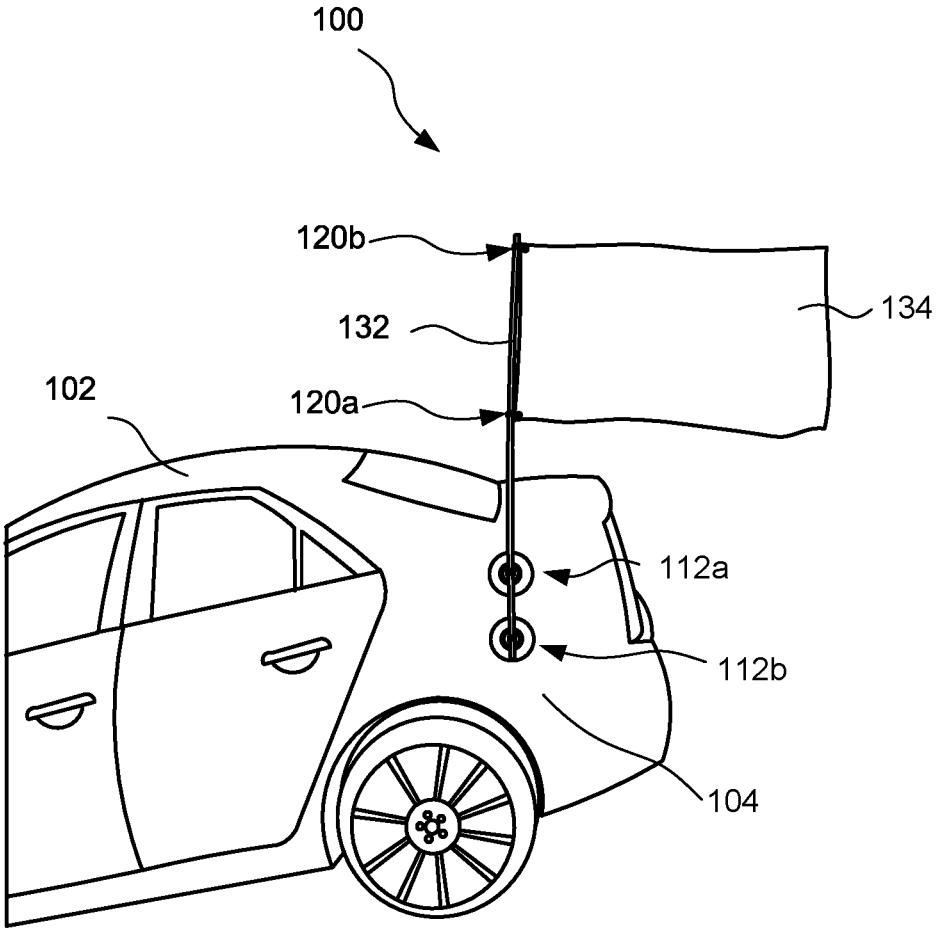
FIG. 1 is a side view of a flag holder mounted to a rear side panel of a vehicle, according to one or more examples of the present disclosure.

Looking first at FIG. 1, one embodiment of a flag holder 100 for securely mounting a flag 134 on a vehicle 102, even while the vehicle 102 travels at highway speeds, is depicted. The flag holder 100 includes a first suction cup assembly 112*a* and a second suction cup assembly 112*b*, both releasably (e.g., removably) secured to the vehicle 102. The first suction cup assembly 112*a* and the second suction cup assembly 112*b* are shown releasably secured to a rear side panel 104 of the vehicle 102.

The first suction cup assembly 112*a* and the second suction cup assembly 112*b* are releasably secured to the vehicle 102 by placing a cupped surface of the first and second suction cup assemblies against a surface of the vehicle 102 and depressurizing the space between the surface of the vehicle 102 and the cupped surface of the suction cup assemblies 112*a*, 112*b*.

The first suction cup assembly 112*a* and the second suction cup assembly 112*b* are adapted to move independently of each other. In other words, the distance between the first suction cup assembly 112*a* and the second suction cup assembly 112*b* may be adjusted. The distance may be adjusted to adapt the flag holder 100 to fit a larger or smaller area on the vehicle 102, such as to accommodate different flag sizes and automobile speeds. With an adjustable distance between the suction cup assemblies 112*a*, 112*b*, the flag holder 100 may be removably secured to the vehicle 102 in a variety of areas and orientations. Depicted herein, the suction cup assemblies 112*a*, 112*b* are removably secured to a rear back panel 104 (see FIG. 1), a rear side window 106 (see FIG. 5), and a rear trunk panel 108 (see FIG. 6). In addition to those depicted, the flag holder 100 may be secured to any surface of the vehicle 102 large enough to fit one or both of the suction cup assemblies 112*a*, 112*b*.

The first suction cup assembly 112*a* and the second suction cup assembly 112*b* may be vertically aligned with one suction cup assembly (such as the first suction cup assembly 112*a*) vertically above or below the other suction cup assembly (such as the second suction cup assembly 112*b*). The first suction cup assembly 112*a* and the second suction cup assembly 112*b* may be aligned in other orientations including horizontal or angled as desired.

The first suction cup assembly 112*a* and the second suction cup assembly 112*b* are adapted to move (e.g. pivot) independently of one another. In other words, the surface on which the first suction cup assembly 112*a* and the second suction cup assembly 112*b* are removably secured may not need to be flat. Moreover, the surface on which the first suction cup assembly 112*a* is removably secured may not be co-planar with the surface to which the second suction cup assembly 112*b* is removably secured. Accordingly, the first suction cup assembly 112*a* and the second suction cup assembly 112*b* may be removably secured to any flat and/or curvilinear surface(s) of the vehicle 102 or to multiple surfaces angled relative to each other.

In addition, the first suction cup assembly 112*a* and the second suction cup assembly 112*b* may be removably secured to different surfaces of the vehicle 102. For example, the first suction cup assembly 112*a* may be removably secured to the rear side window 106 while the second suction cup assembly 112*b* is removably secured to the rear door.

The suction cup assemblies 112*a*, 112*b* may be heavy duty suction cups. Without limitation, industrial one hundred and forty millimeter to one hundred and fifty millimeter suction cups, such as those made by Etol Rubber & Plastic Co., may be used. Each suction cup assembly 112*a*, 112*b* may have a built-in vacuum pump 142 (see, for example, FIG. 3), which may be actuated by pressing a button 140 or other actuator. In the present embodiment, each suction cup assembly 112*a*, 112*b* may be evacuated to provide a support rating of roughly 110 pounds of force, resulting in a combined strength of 220 pounds of strength when two suction cup assemblies 112*a*, 112*b* are removably mounted to a surface, such as the surface of a vehicle 102 (see FIG. 1). Other types of suitable heavy duty suction cups may also be used.

Each suction cup assembly 112*a*, 112*b* may be positioned on a desired surface of the vehicle 102. A user may repeatedly press the buttons 140 on the suction cup assemblies 112*a*, 112*b* multiple times to expel all of the air between each suction cup assembly 112*a*, 112*b* and the surface of the vehicle 102 to create a strong vacuum grip between the suction cup assembly 112*a*, 112*b* and the surface of the vehicle 102. Additional suction cup assemblies 112*a*, 112*b* may be used as needed to increase the strength with which the suction cup assemblies 112*a*, 112*b* resist or counteract any force that will be exerted on them by the pole 132 as the flag 134 blows in the wind (e.g., drag that is generated as the vehicle 102 travels, etc.).

Although depicted as a releasably secured to a car, the flag holder 100 may be releasably secured to any type of moving vehicle including, but not limited to, trucks, cars, vans, buses, all-terrain vehicles, boats, planes, etc.

Figure 8:
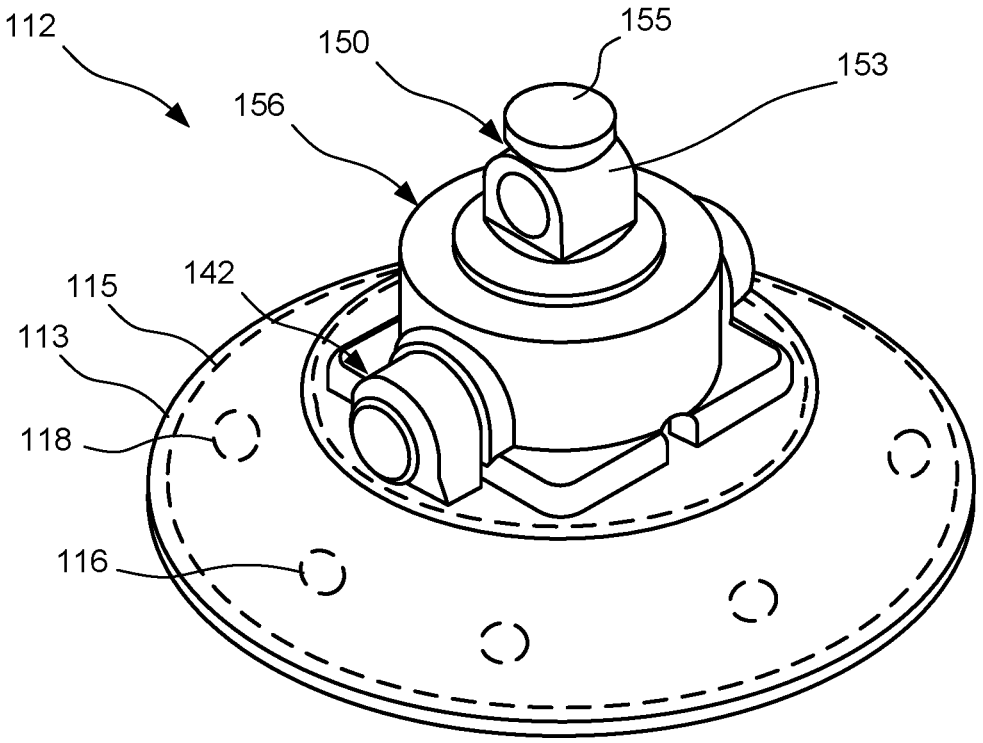
FIG. 8 is a perspective view of a suction cup assembly, according to one or more examples of the present disclosure.
Figure 9:
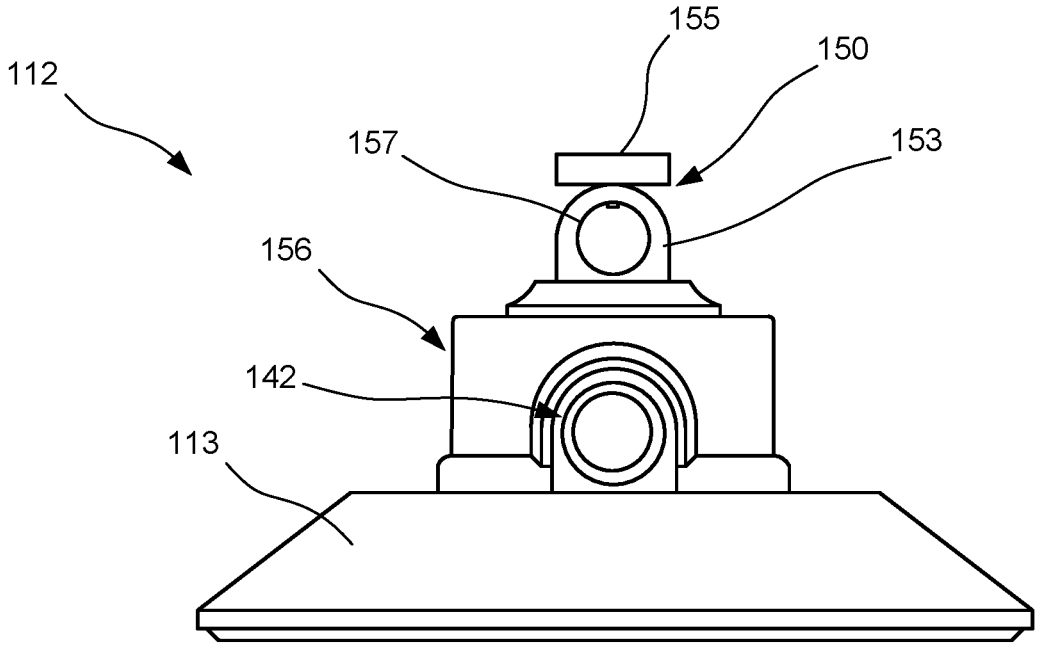
FIG. 9 is a front view of a suction cup assembly, according to one or more examples of the present disclosure.
Figure 10:
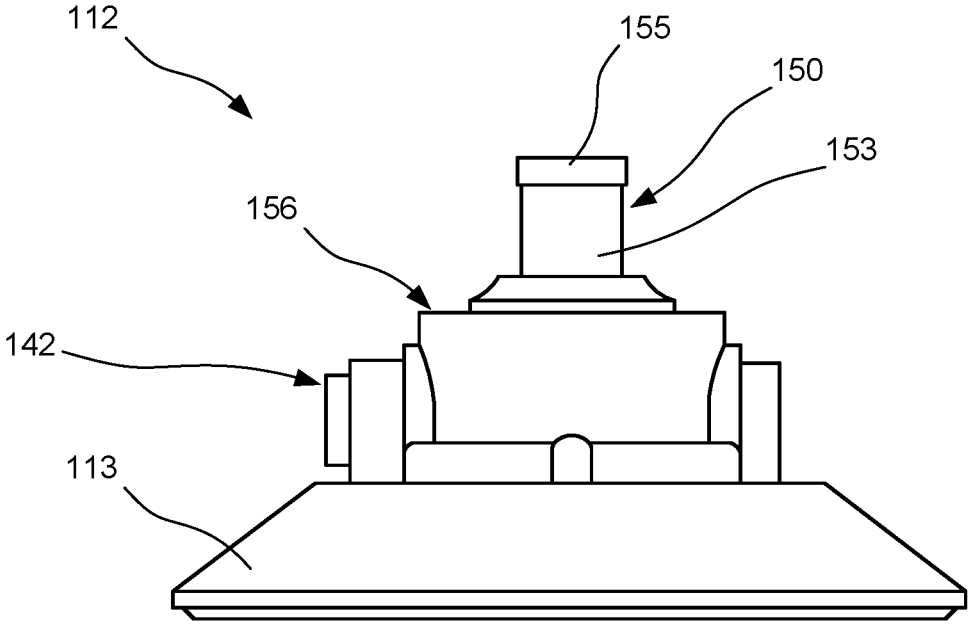
FIG. 10 is a side view of a suction cup assembly, according to one or more examples of the present disclosure.
Figure 11:
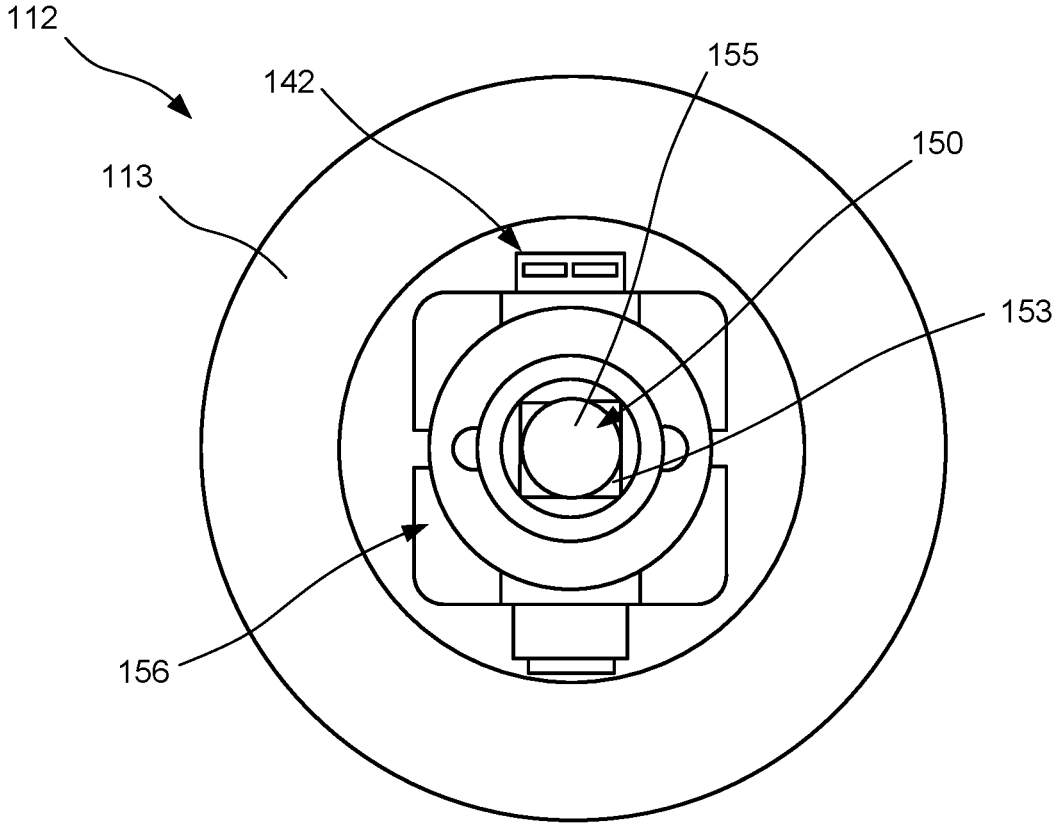
FIG. 11 is a top view of a suction cup assembly, according to one or more examples of the present disclosure.
Figure 12:
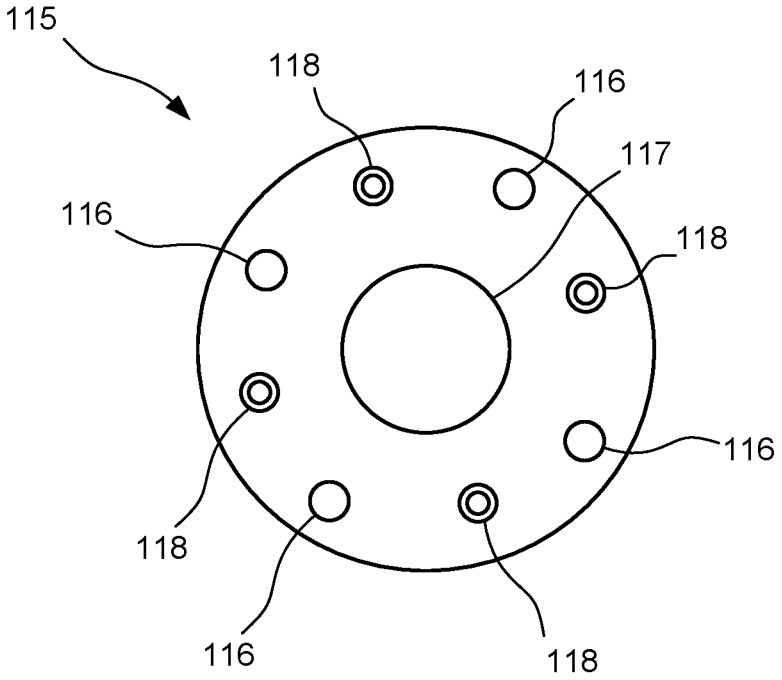
FIG. 12 is a top view of a plate, according to one or more examples of the present disclosure.
Figure 13:
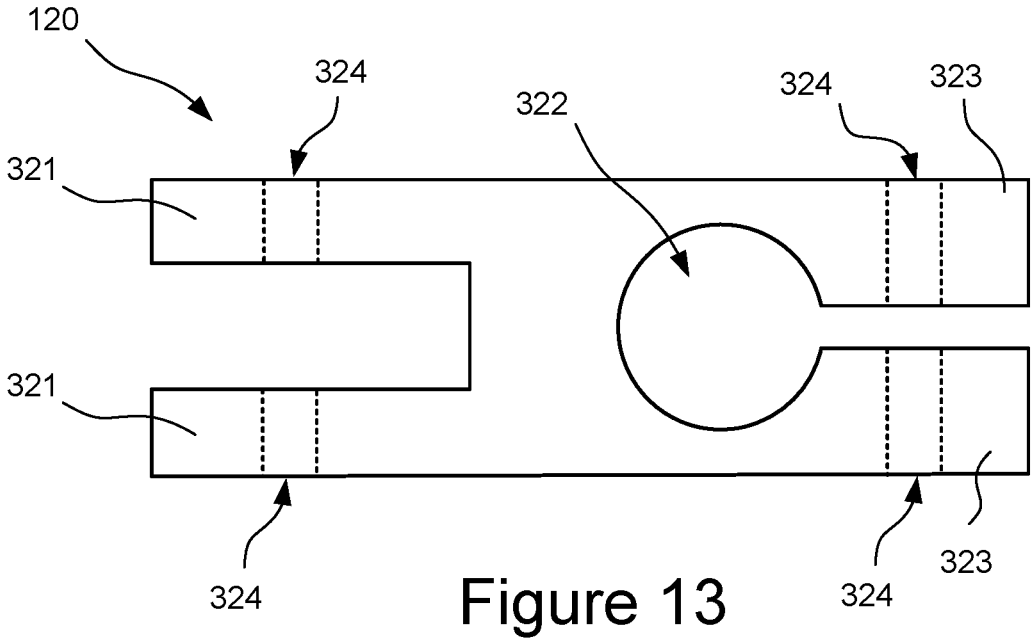
FIG. 13 is a top view of a flag attachment device, according to one or more examples of the present disclosure.
Figure 14:
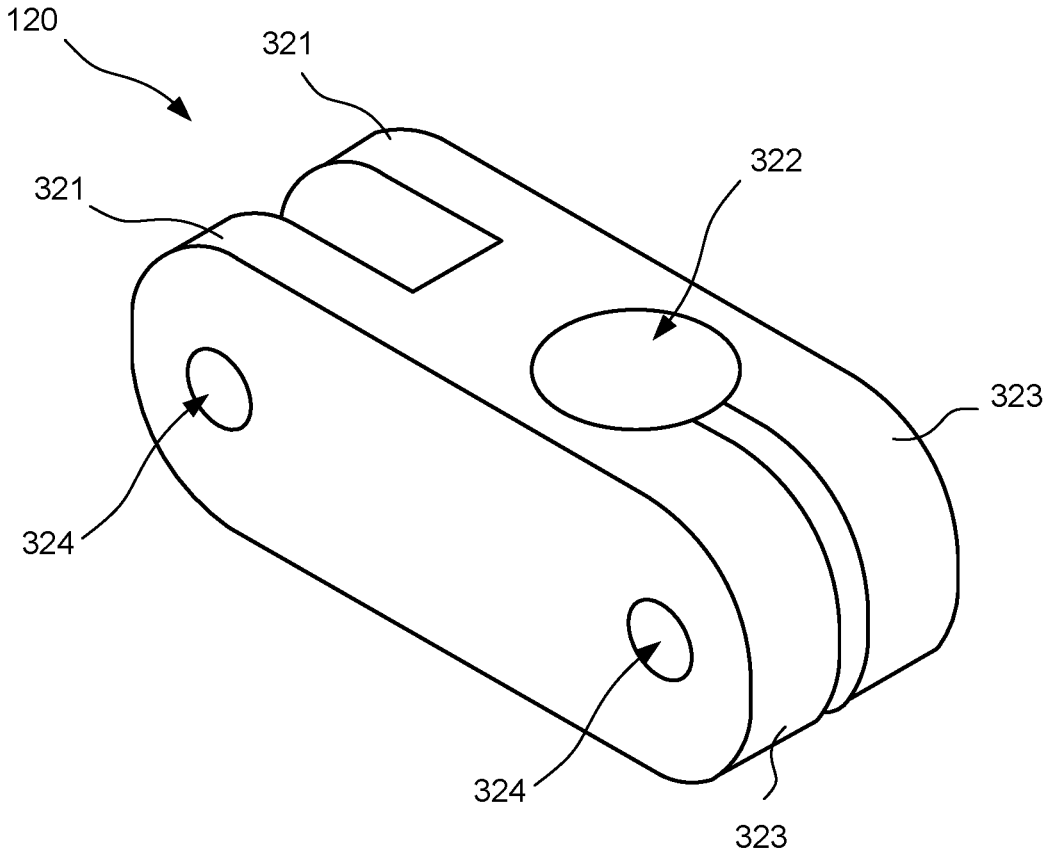
FIG. 14 is a perspective view of a flag attachment device, according to one or more examples of the present disclosure.
Figure 15:
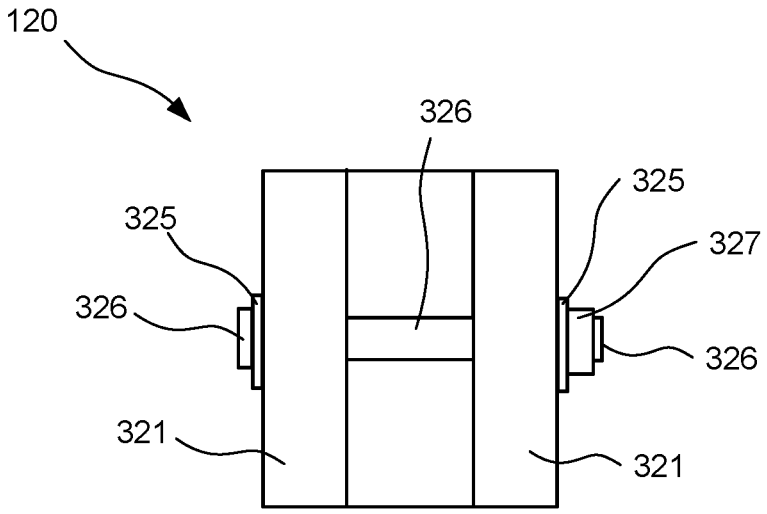
FIG. 15 is a front view of a flag attachment device, according to one or more examples of the present disclosure.
Figure 16:
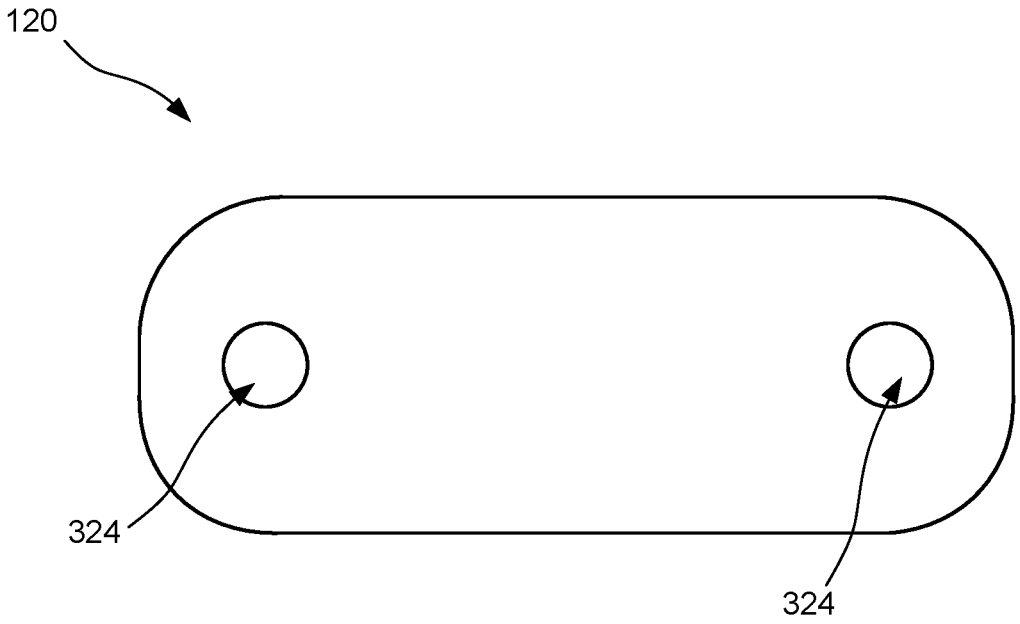
FIG. 16 is a side view of a flag attachment device, according to one or more examples of the present disclosure.

Each of the suction cup assemblies 112*a*, 112*b* includes a suction cup 113. In some embodiments, the suction cup 113 of each of the suction cup assemblies 112*a*, 112*b* includes an embedded plate 115 embedded in the suction cup 113 (as shown in dashed lines in FIG. 12). The plate 115 may be metal or other strong and/or stiff material. The plate 115 may be embedded in the suction cup 113 of the suction cup assemblies 112*a*, 112*b* to increase the strength or other mechanical properties of the suction cup 113 of the suction cup assemblies 112*a*, 112*b*. Referring to FIG. 12, the plate 115 includes a center hole 117 and a plurality of peripheral holes 116. The placement of such holes 116, 117 may reduce material costs with minimal reduction in mechanical properties. The holes 116, 117 may also enhance formation of the suction cup assembly around the plate 115 to increase stability of the metal plate 115 within the suction cup assemblies 112*a*, 112*b*. The plate 115 further includes protrusions 118 which may further enhance the structural stability of the metal plate 115 within the suction cup assemblies 112*a*, 112*b*. As shown in FIG. 8, the plate 115 occupies only a portion of the suction cup 113 of a suction cup assembly 112 so as not to impede the ability of the suction cup 113 to flexibly suction to the vehicle.

A flag pole 132 spans between the suction cup assemblies 112*a*, 112*b*, thus interconnecting the first suction cup assembly 112*a* and the second suction cup assembly 112*b*. The flag pole 132 is secured to the first suction cup assembly 112*a* and the second suction cup assembly 112*b* via attachment devices 150 (see, for example, FIG. 3).

The flag pole 132 is securely connected to the suction cup assemblies 112*a*, 112*b* by attachment members 150 that are secured to and may surround portions of the flag pole 132. The attachment members 150 connect the flag pole 132 to mounts 156 on the suction cup assemblies 112*a*, 112*b*. The mounts 156 surround the vacuum pumps 142 and are attached to the suction cup assemblies 112*a*, 112*b* by fasteners 158. The attachment members 150 may be releasably secured by the mounts 156. The positions of the attachment members 150 along a length of the pole 132 may be easily adjusted to accommodate different arrangements of and spacing distances between the suction cup assemblies 112*a*, 112*b* on the vehicle 102. In some embodiments, the vacuum pumps 142 are integrated into the suction cup assemblies 112*a*, 112*b*. In some embodiments the vacuum pumps 142 are releasably coupled to the suction cup assemblies 112*a*, 112*b*. In some embodiments, the suction cup assemblies 112*a*, 112*b* include quick release mechanisms (e.g., lever, release valve, button, actuator, etc.) which allow for the rapid release of the suction cup assemblies 112*a*, 112*b* from the vehicle 102.

The attachment devices 150 are attached to the suction cup assemblies 112*a*, 112*b*. The attachment devices 150 may be attached to the suction cup assemblies 112*a*, 112*b* at any exposed surface of the suction cup assemblies 112*a*, 112*b*. In the illustrated embodiment, the attachment device 150 is attached to respective suction cup assemblies 112*a*, 112*b* at a raised surface on the mount 156. With the attachment device 150 secured to a raised surface of the suction cup assembly 112, the flag pole 132 is positioned away from the surface of the vehicle 102 to ensure the flag pole 132 does not contact the surface of the vehicle 102 even with highly convex surfaces between the first suction cup assembly 112*a* and the second suction cup assembly 112*b*.

The flag pole 132 is slidably secured to the attachment device 150. That is, the attachment devices 150 are adapted to allow the suction cup assemblies 112*a*, 112*b* to slide along the length of the flag pole 132 allowing a user to adjust the distance between the first suction cup assembly 112*a* and the second suction cup assembly 112*b*. In other words, the attachment device 150 is slidably adjustable along the flag pole 132. In some embodiments, both the attachment devices 150 are slidably adjustable along the flag pole 132. In some embodiments, the attachment device 150 on the second suction cup assembly 112*b* is fixed at a base of the flag pole 132 and only the attachment device 150 on the first suction cup assembly 112*a* is slidably adjustable along the flag pole 132. In such embodiments, the distance between the first and second suction cup assemblies 112*a*, 112*b* is adjusted by moving the first suction cup assembly 112*a* along the flag pole 132.

In addition, the attachment device 150 is adapted to allow rotation of the flag pole 132 relative to the suction cup assembly 112*a*. That is, the flag pole 132 may rotate to various orientations with respect to the suction cup assembly 112*a*. Stated another way, the first suction cup assembly 112*a* is pivotable relative to the flag pole 132. The orientation of the flag pole 132 may be limited by the connection to the two separate suction cup assemblies 112*a*, 112*b* as the flag pole 132 will span between the two suction cup assemblies 112*a*, 112*b*.

Figure 3:
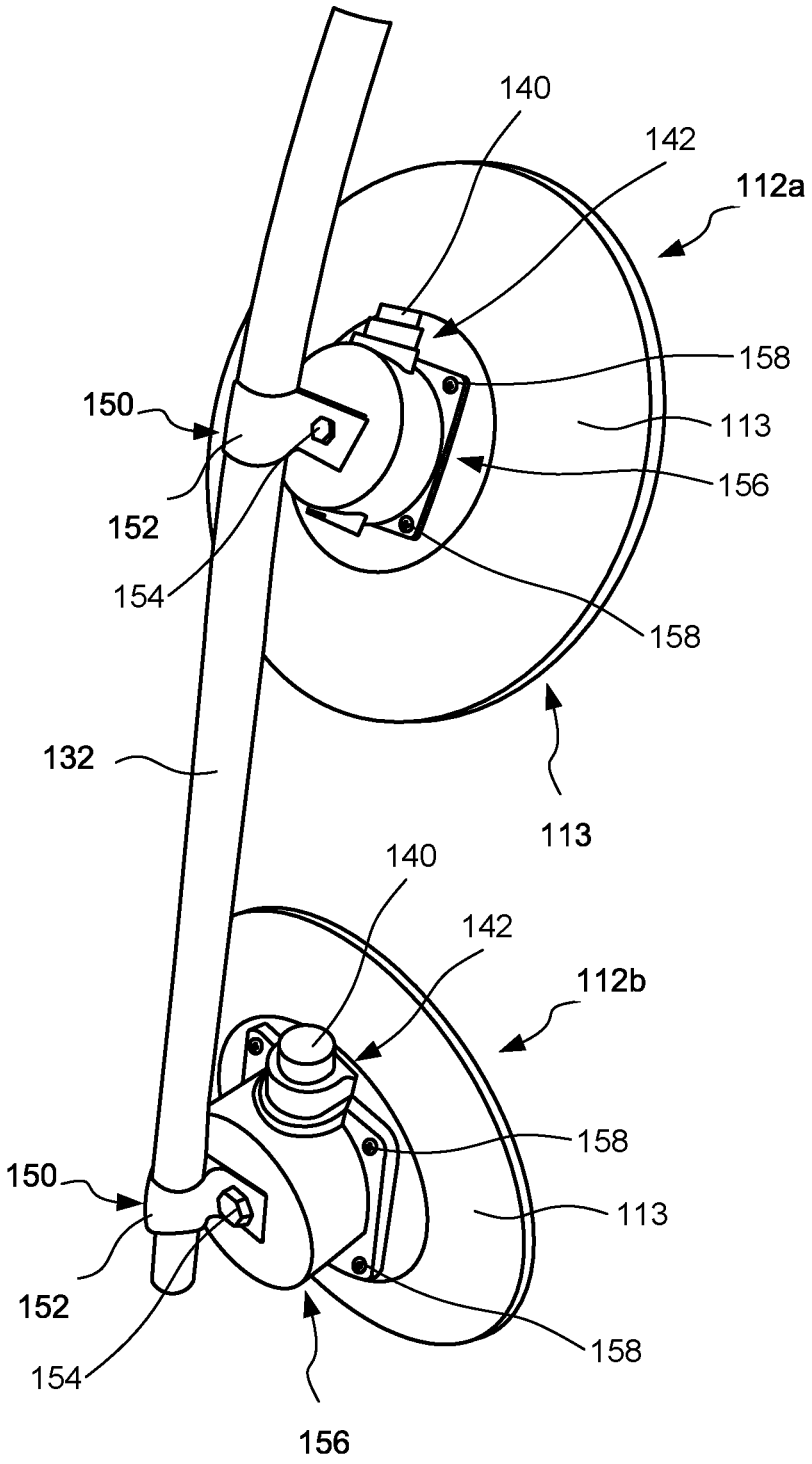
FIG. 3 is a perspective view of a flag holder having two suction cup assemblies, two attachment devices, and a flag pole interconnecting the two suction cup assemblies, according to one or more examples of the present disclosure.

Referring to FIG. 3, the attachment device 150 includes a bracket 152 and a fastener 154 to secure the bracket to the mount 156. The bracket 152 encircles the flag pole 132 and attaches to the mount 156 and the suction cup assembly 112*a* via the fastener 154. In some embodiments, the bracket 152 is pivotable about the fastener 154 allowing for the suction cup assembly 112*a* to be pivotable relative to the flag pole 132.

Other fastening devices may be utilized to secure the flag pole 132 to the suction cup assemblies including clamps or other means. In an example, a pipe clamp may be utilized, which may be loosened to allow the suction cup assembly 112*a*, 112*b* to slide along the length of the flag pole 132 and be tightened to secure the flag pole 132 in place once the suction cup assemblies 112*a*, 112*b* are desirably located along the flag pole 132. In some embodiments, the attachment device 150 is integral with the suction cup assembly 112*a*.

Referring to FIGS. 8-11, another example of an attachment device 150 is shown. The attachment device 150 in FIGS. 8-11 includes a bar receptacle 153 integrally secured to, and forms a one-piece monolithic structure with, a mount 156. The bar receptacle 153 includes a socket 157 through which the flag pole 132 can fit and a compression screw 155 which may be tightened down into the socket to press against the flag pole 132 and secure the flag pole 132 to the attachment device 150.

Figure 2:
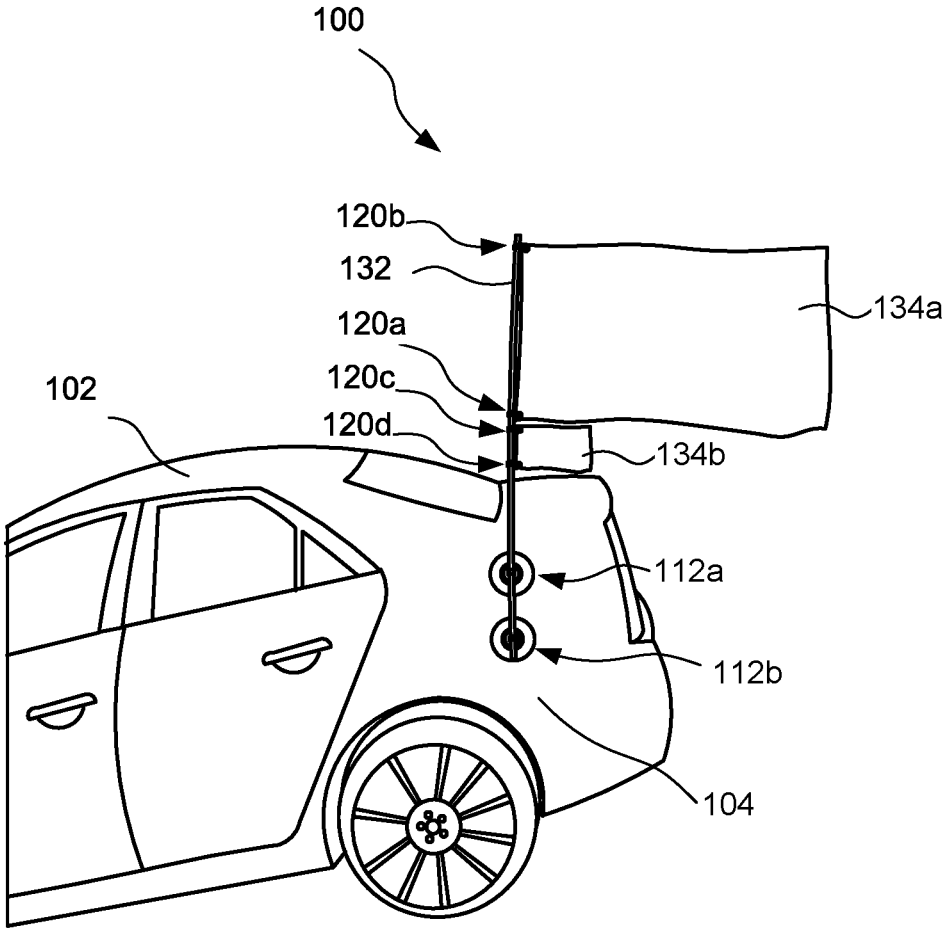
FIG. 2 is a side view of a flag holder mounted to a rear side panel of a vehicle, with two flags coupled to the flag holder, according to one or more examples of the present disclosure.

The flag pole 132 is slightly flexible. For example, the flag pole 132 may comprise a woven fiberglass rod. The flag pole 132 may be a filament wound epoxy tube, created by winding fiberglass filaments around a mandrel (similar to wrapped carbon tubing). Filament wound epoxy tubes are lightweight and strong and can be less flexible than solid fiberglass. Such a fiberglass tube may have alternating longitudinal and wrapped layers resulting in a lightweight composite of high tensile, compressive, and flexural strength. The fiberglass tube may be radiolucent, as well as electrically and thermally insulating. The flag pole 132 may have a length of about four feet, although flag poles 132 with longer or shorter lengths may also be used. Referring to FIG. 2, the flag pole 132 is of a length to allow for the attachment of two flags 134*a*, 134*b*. The second flag 134*b* is attached via flag attachment devices 120*c*, 120*d*.

The flag 134 may be any size, large or small, or any combination of large or small flags, banners or pennants of any shape. Common large flag sizes are rectangular 3 feet by 5 feet, 1 foot by 2 feet, and 1 foot by 5 feet, but any size and shape of flag may be used with a flag holder 100 according to this disclosure. Large flags that are used with such a flag holder 100 may be made of any of a variety of different materials, including, without limitation, polyester, cotton, and canvas.

Figure 4:
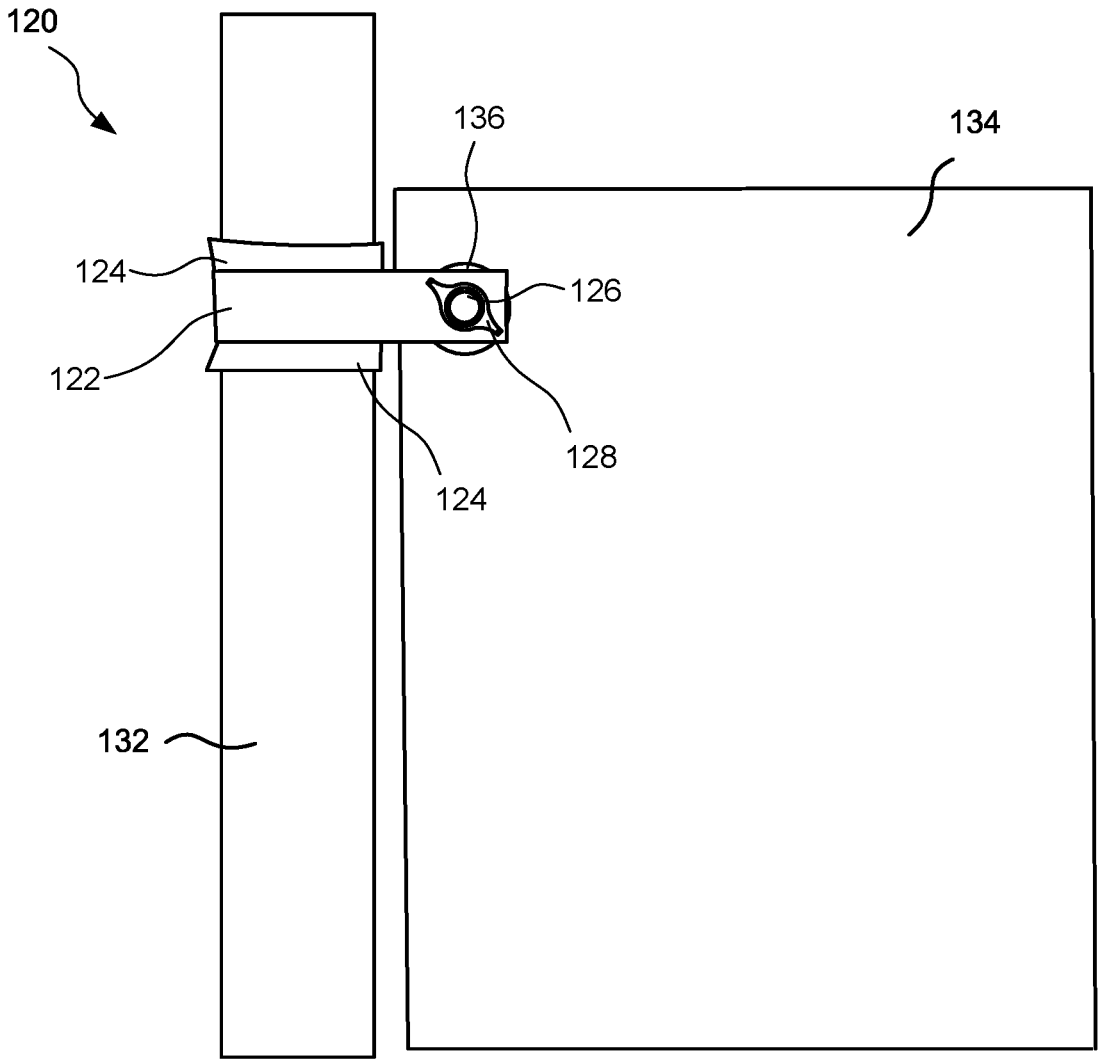
FIG. 4 is a side view of a flag attachment device of a flag holder, according to one or more examples of the present disclosure.

Referring to FIGS. 1 and 2, flag attachment devices 120*a*, 120*b* are movably secured to the flag pole 132 at locations on the flag pole. The flag attachment device 120 of FIG. 4 represents an example of the flag attachment devices 120*a*, 120*b*. The attachment location of the flag attachment device 120 is adjustable along a length of the flag pole 132. In the illustrated embodiment, a wing nut 128 and complementary bolt 126 secures the flag 134 to the flag pole 132. A bracket 122 is secured via the wing nut 128 and bolt 126 which are secured through a grommet 136. The flag attachment device 120 further includes a pad 124 to restrict movement of the flag attachment device 120 once it is secured to the flag pole 132. Other conventional attachment elements may also be used to secure the flag 134 to the pole 132 including any combination of clamps, fasteners, brackets, ropes, straps, cinches, etc.

Referring to FIGS. 13-16, an example of a flag attachment device 120 is shown. The flag attachment device 120 includes a pair of prongs 321 with a gap or space between the prongs 321. Each of the prongs 321 includes a through-hole 324 through which a bolt or other fastening apparatus can extend when secured to the prongs 321 via a nut or other retention device. The bolt or other fastening apparatus may be passed through a grommet 136 in a flag 134 before being secured to the prongs 321. On an opposite end of the flag attachment device 120 are clamp arms 323 with a gap or space between the clamp arms 323. Each of the clamp arms 323 includes a through-hole 324 through which a bolt or other fastening apparatus can extend before the clamp arms 323 are flexed toward each other, via a nut or other retention device. The flag attachment device 120 further includes a circular cavity 322 through which the flag pole 132 is positionable. With the flag pole 132 positioned in the circular cavity 322 at a desired location along the flag pole 132, the clamp arms 323 can be flexed together by a bolt or other fastening apparatus such that the clamp arms 323 defining the circular cavity 322 clamp down on the flag pole 132.

The suction cup assemblies 112*a*, 112*b* may be interconnected by the pole 132. More specifically, the suction cup assemblies 112*a*, 112*b* are securely affixed to the side of the vehicle 102 with the pole 132 connected to the mounts 156 on both suction cup assemblies 112*a*, 112*b*. The flag pole 132 may extend generally upward from the mounts 156 on the suction cup assemblies 112*a*, 112*b*. Together, the suction cup assemblies 112*a*, 112*b* may cooperate in resisting or counteracting the force applied to them by the pole 132 as wind blows the flag 134.

As the vehicle 102 moves forward, movement of the vehicle 102 and wind resistance to such movement generate a shear force along the side of the vehicle 102, including the surface to which the flag holder 100 is (i.e., its suction cup assemblies 112*a*, 112*b* are) mounted. In addition, wind resistance exerts force on a flag 134 carried on the outside of the vehicle. The force of wind resistance on the flag 134 is transferred to the pole 132. The pole 132 then acts as a lever that exerts a rotational force on the suction cup assemblies 112*a*, 112*b*. The suction cup assemblies 112*a*, 112*b* work together to resist or counteract this rotational force and to maintain the pole 132 in an upright orientation and the flag 134 in a flying position. This cooperative system of suction cup assemblies 112*a*, 112*b* couples the vacuum strength of two or more suction cup assemblies 112, so that they collectively resist or counteract the rotational force of the pole 132 as wind resistance acts on the flag 134. Consequently, the coupled system shown in this embodiment will successfully support a large flag 134 on a vehicle 102 moving at highway speeds.

Contrast the above system with a prior art flag arrangement having a suction cup on the top or trunk of a vehicle. In that position, as the vehicle moves, a force is exerted on a flag and then on the suction cup, eventually overcoming the vacuum that holds the suction cup in place on the vehicle. Additional suction cups in that position would tend to be peeled off of the vehicle top or trunk sequentially without working together to resist or counteract the wind resistance, as in the embodiments of the present disclosure.

Figure 5:
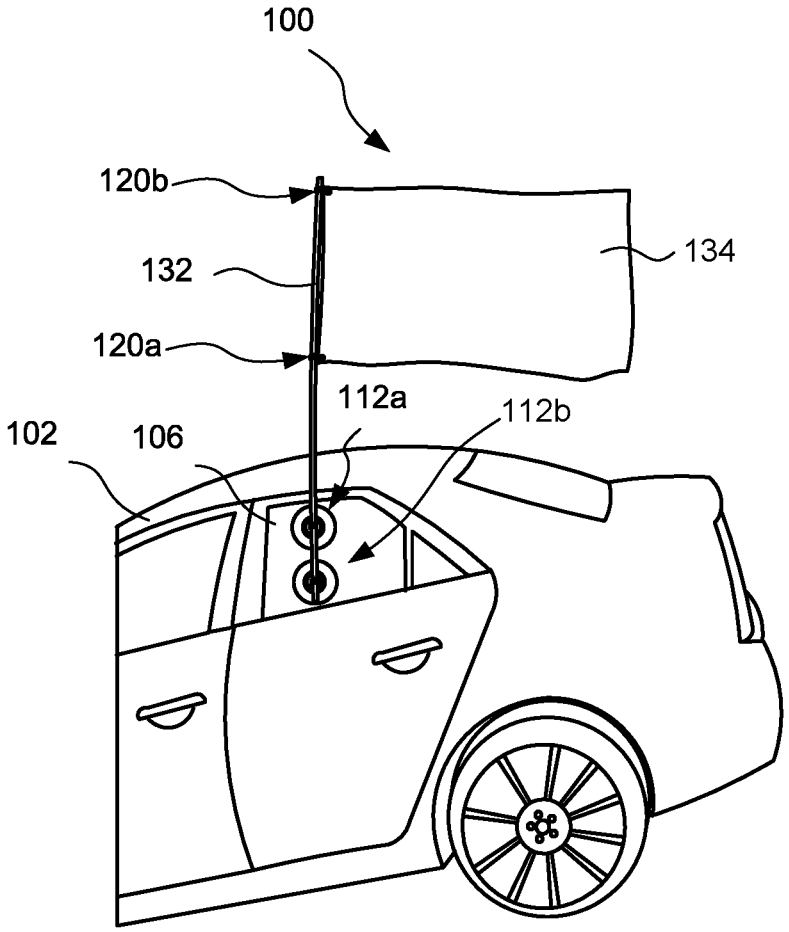
FIG. 5 is a side view of a flag holder mounted to a rear side window of a vehicle, according to one or more examples of the present disclosure.

Referring to FIG. 5, an alternate embodiment is shown, wherein suction cup assemblies 112*a*, 112*b* may be vertically positioned on a rear side window 106 with flag pole 132 connected to suction cup assemblies 112*a*, 112*b* and extending vertically to fly a flag 134. The operation of this alternate embodiment is essentially the same as that of flag display discussed above.

Figure 6:
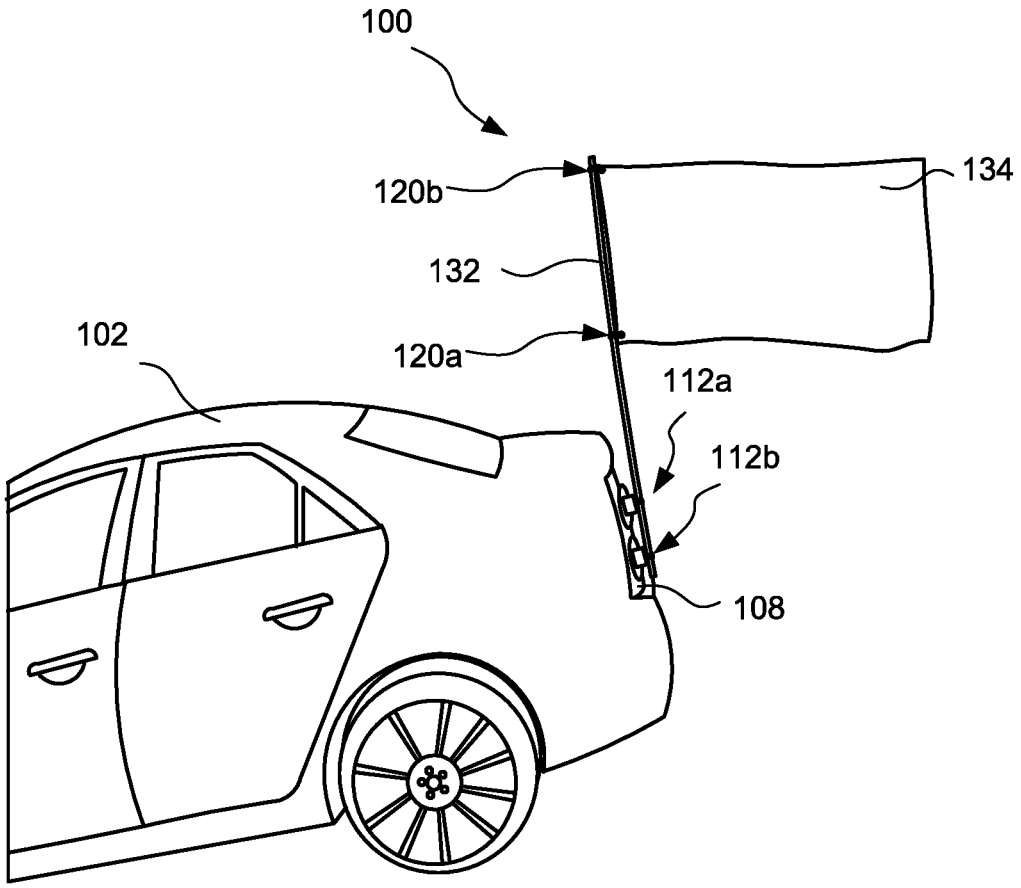
FIG. 6 is a side view of a flag holder mounted to a trunk panel of a vehicle, according to one or more examples of the present disclosure.

Referring to FIG. 6, suction cup assemblies 112*a*, 112*b* are arranged on a trunk panel 108 of a vehicle 102. A flag pole 132 is connected to suction cup assemblies 112*a*, 112*b* and extends substantially vertically to display flag 134.

As described herein, in some embodiments, the first and second suction cup assemblies 112*a*, 112*b* are interconnected by the flag pole 132. In some embodiments, the first and second suction cup assemblies 112*a*, 112*b* are interconnected by other mechanical means. The mechanical connection between the first and second suction cup assemblies 112*a*, 112*b* allows for the first and second suction cup assemblies 112*a*, 112*b* to move (translationally and rotationally) relative to each other.

Referring to FIGS. 8-11, the mount 156, the attachment device 150, and the suction cup assembly 112 are one custom molded piece as opposed to separate pieces that are secured to each other.

Figure 7:
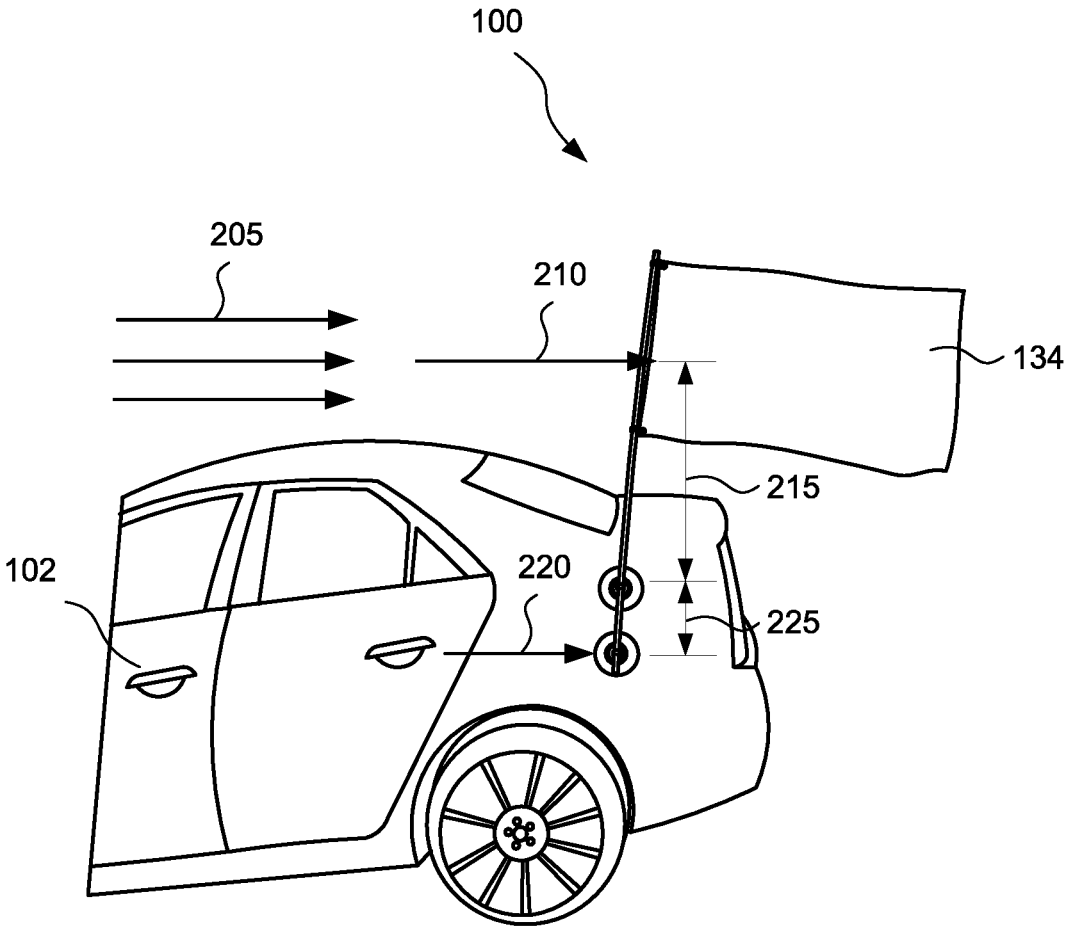
FIG. 7 is a side view of a flag holder mounted to a vehicle and depicting various forces acting on the flag holder as the vehicle is in motion, according to one or more examples of the present disclosure.

Referring to FIG. 7, a vehicle 102 is depicted moving at a high speed. A wind 205 exerts a drag force 210 on the flag 134 and the flag pole 132. As is understood, the height of the flag pole 132, the size of the flag 134, the placement of the flag 134, the material properties of the flag 134, and the speed of the vehicle 102 among other variables will affect the drag force exerted on the flag holder 100.

While the drag force is distributed along the flag 134 and flag pole 132, an equivalent drag force 205 to the total distributed drag force is represented by an arrow at a distance 215 above the first suction cup assembly 112*a*. The equivalent drag force 205 at the distance 215 exerts a moment about the first suction cup assembly 112*a*. With two suction cup assemblies 112*a*, 112*b* secured to the vehicle 102, the load and moment is cooperatively distributed to both suction cup assemblies 112*a*, 112*b*. If the countervailing forces and moments at the suction cup assemblies 112*a*,

112*b* are sufficient the flag holder 100 will remain secured to the vehicle 102 even at high rates of speed.

In the illustrated embodiment, the drag force 205 is cooperatively opposed by the two suction cup assemblies 112*a*, 112*b*. For example, moment of the drag force about the upper suction cup assembly is opposed by a moment at the upper suction cup assembly (as the suction cup assembly opposes rotating on the vehicle surface. In addition, the lower suction cup assembly will have a reactionary translational force, represented by arrow 220 at a distance 225 which creates a moment in the opposite direction of the drag force. As the distance between two suction cup assemblies 112*a*, 112*b* is increased, the reactionary translational force is decreased. In addition, the distance 215 would also decrease as the upper suction cup assembly is moved up the flag pole 132.

Similarly, calculating the reactionary forces acting about the lower suction cup assembly would also show that the reactionary forces are distributed with between the two suction cup assemblies 112*a*, 112*b*. As the distance between the two suction cup assemblies 112*a*, 112*b* increases, the reactionary forces may decrease.

Accordingly, the flag display apparatus of the present invention provides a flag pole with substantial strength and resistance to flexibility to carry a large flag on a vehicle. The flag pole is connected to heavy duty suction cup assemblies on the vehicle that cooperatively resist the wind force exerted on the large flag at speeds of over seventy miles per hour. The result is a strong apparatus for safely displaying one or more flags, pennants or banners of any size on a vehicle traveling at highway speeds.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. An apparatus for displaying a flag on a vehicle while the vehicle moves at a high speed, comprising:

a first suction cup assembly adapted to be releasably secured to the vehicle;

a second suction cup assembly adapted to be releasably secured to the vehicle;

a first attachment device secured to the first suction cup assembly;

a second attachment device secured to the second suction cup assembly, wherein the first attachment device is physically separated and spaced apart from the second attachment device; and a flag pole secured, at a first location along the flag pole, directly to the first attachment device and secured, at a second location along the flag pole, directly to the second attachment device, wherein the first location is spaced apart from the second location;

wherein the first attachment device and the second attachment device are slidably movable along the flag pole independently of each other.

2. The apparatus of claim 1, wherein the suction cup assemblies are adapted to fixedly secure to a curvilinear surface of the vehicle.

3. The apparatus of claim 1, wherein:

the first suction cup assembly is pivotable relative to the flag pole; and the second suction cup assembly is pivotable relative to the flag pole.

4. The apparatus of claim 3, wherein:

the first suction cup assembly and the second suction cup assembly are spaced apart from each other in a first direction; and the flag pole is parallel to the first direction.

5. The apparatus of claim 4, wherein at least one of:

the first attachment device is slidably adjustable along the flag pole to adjust a distance between the first suction cup assembly and the second suction cup assembly; and the second attachment device is slidably adjustable along the flag pole to adjust a distance between the first suction cup assembly and the second suction cup assembly.

6. The apparatus of claim 1, wherein the first and second suction cup assembly each comprises an integrated vacuum pump.

7. The apparatus of claim 1, further comprising;

a first flag attachment device fixedly secured to the flag pole at a third location along the flag pole; and a second flag attachment device fixedly secured to the flag pole at a fourth location along the flag pole.

8. The apparatus of claim 7, wherein:

the first flag attachment device is further movably secured to the flag pole such that the third location is adjustable;

the second flag attachment device is further movably secured to the flag pole such that the fourth location is adjustable; and a distance between the third location and the fourth location is adjustable.

9. The apparatus of claim 8, further comprising;

a third flag attachment device fixedly secured to the flag pole at a fifth location along the flag pole; and a fourth flag attachment device fixedly secured to the flag pole at a sixth location along the flag pole.

10. The apparatus of claim 1, wherein the flag comprises a size of at least three feet by five feet.

11. The apparatus of claim 10, wherein the high speed is at least sixty miles per hour.

12. The apparatus of claim 1, wherein the first suction cup assembly and the second suction cup assembly are attachable to a side of the vehicle.

13. The apparatus of claim 1, wherein the first suction cup assembly and the second suction cup assembly are attachable to a rear side window of the vehicle.

14. The apparatus of claim 1, wherein the first suction cup assembly and the second suction cup assembly are attachable to a trunk panel of the vehicle.

15. The apparatus of claim 1, wherein the first suction cup assembly and the second suction cup assembly each includes a suction cup having a diameter of at least one hundred and forty millimeters.

16. The apparatus of claim 1, wherein:

the first suction cup assembly is translationally non-movable relative to the first attachment device; and the second suction cup assembly is translationally non-movable relative to the second attachment device.

17. The apparatus of claim 1, wherein:

the first suction cup assembly comprises a first suction cup and a first plate embedded in the first suction cup; and the second suction cup assembly comprises a second suction cup and a second plate embedded in the second suction cup.

18. An apparatus for displaying a flag on a vehicle while the vehicle moves at a high speed, comprising:

a first suction cup assembly adapted to be releasably secured to the vehicle;

a second suction cup assembly adapted to be releasably secured to the vehicle;

a flag pole;

a means for attaching the flag pole at a first location along the flag pole to the first suction cup assembly; and a means for attaching the flag pole at a second location along the flag pole to the second suction cup assembly;

wherein:

the means for attaching the flag pole to the first suction cup assembly is physically separated and spaced apart from the means for attaching the flag pole to the second suction cup assembly; and the means for attaching the flag pole to the first suction cup assembly and the means for attaching the flag pole to the second suction cup assembly are slidably moveable along the flag pole independently of each other.

19. The apparatus of claim 18, further comprising;

a means for attaching the flag to the flag pole at a third location along the flag pole; and a means for attaching the flag to the flag pole at a fourth location along the flag pole.

20. An apparatus for displaying a flag on a vehicle while the vehicle moves at a high speed, comprising:

a first suction cup assembly adapted to be releasably secured to the vehicle, the first suction cup assembly comprising a first integrated vacuum pump;

a second suction cup assembly adapted to be releasably secured to the vehicle, the second suction cup assembly comprising a second integrated vacuum pump, wherein the first suction cup assembly and the second suction cup assembly include at least one hundred and forty millimeter suction cups;

a first attachment device secured to the first suction cup assembly;

a second attachment device secured to the second suction cup assembly, wherein the first attachment device is physically separated and spaced apart from the second attachment device;

a flag pole, comprising fiberglass, directly secured, at a first location along the flag pole, to the first attachment device and directly secured, at a second location along the flag pole, to the second attachment device, wherein the first location is spaced apart from the second location, wherein:

the first attachment device is slidably adjustable along the flag pole to adjust a distance between the first suction cup assembly and the second suction cup assembly;

the first attachment device and the second attachment device are slidably movable along the flag pole independently of each other;

the first suction cup assembly is pivotable relative to the flag pole; and the second suction cup assembly is pivotable relative to the flag pole;

a first flag attachment device fixedly secured to the flag pole at a third location along the flag pole, wherein the first flag attachment device is further movably secured to the flag pole such that the third location is adjustable; and a second flag attachment device fixedly secured to the flag pole at a fourth location along the flag pole, wherein the second flag attachment device is further movably secured to the flag pole such that the fourth location is adjustable.

* * * * *